US005833064A

United States Patent [19]

Ayres et al.

[11] Patent Number: 5,833,064

[45] **Date of Patent: *Nov. 10, 1998**

[54] STRING OF ANCHOR CLIPS

[75] Inventors: Donald B. Ayres; Glenn Gustafson, both of Skokie, Ill.

[73] Assignee: Vertex Fasteners, Skokie, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 745,318

[22] Filed: Nov. 12, 1996

Related U.S. Application Data

[63] Continuation-in-part of Ser. No. 649,812, May 17, 1996, abandoned.

[51] Int. Cl.[6] ..... B65D 71/06; A47C 23/00

[52] U.S. Cl. ..... 206/340; 206/344; 206/820; 24/347; 24/350; 24/380

[58] Field of Search ..... 206/338, 340, 206/342, 343–347, 820; 24/347, 350, 380, 295; 29/417

[56] References Cited

U.S. PATENT DOCUMENTS

| | | | |
|---|---|---|---|
| 2,986,793 | 6/1961 | Bright | 24/295 |
| 3,613,878 | 10/1971 | Langas . | |
| 3,708,062 | 1/1973 | Feldheim et al. | 206/340 |
| 3,711,931 | 1/1973 | Ladouceur et al. . | |
| 3,722,670 | 3/1973 | Plunkett . | |
| 3,758,703 | 9/1973 | Golden et al. . | |
| 3,845,860 | 11/1974 | Ladouceur et al. . | |
| 3,851,758 | 12/1974 | Young et al. . | |
| 4,062,087 | 12/1977 | Lingle | 24/347 |
| 4,153,959 | 5/1979 | Omley | 24/350 |
| 4,189,523 | 2/1980 | Pearson . | |
| 4,224,731 | 9/1980 | Lingle . | |
| 4,454,636 | 6/1984 | Pearson | 24/347 |
| 4,508,220 | 4/1985 | Pearson . | |
| 4,648,158 | 3/1987 | West . | |
| 4,791,014 | 12/1988 | West . | |
| 4,935,998 | 6/1990 | Frazier et al. . | |
| 5,303,821 | 4/1994 | Ayres . | |
| 5,314,064 | 5/1994 | Wells et al. | 206/340 |
| 5,314,065 | 5/1994 | Ayres et al. | 206/340 |
| 5,325,964 | 7/1994 | Lyons . | |
| 5,542,775 | 8/1996 | Bechtoldt et al. | 24/350 |
| 5,564,564 | 10/1996 | Poffenberger | 206/338 |

FOREIGN PATENT DOCUMENTS

| | | |
|---|---|---|
| 2023216 | 12/1979 | United Kingdom . |

*Primary Examiner*—Paul T. Sewell
*Assistant Examiner*—Luan K. Bui
*Attorney, Agent, or Firm*—Thomas R. Vigil

[57] ABSTRACT

An elongate string of sheet metal anchor clips includes a series of identical anchor clips disposed in a line, each clip including a flat base portion between a forward, hook shaped end portion and a downturned leg which extends from a corner with the base portion, and a strip of flexible material fixed to each one of the clips to form the string of clips. The strip can have an adhesive on one side thereof for fixing the strip to each clip.

18 Claims, 9 Drawing Sheets

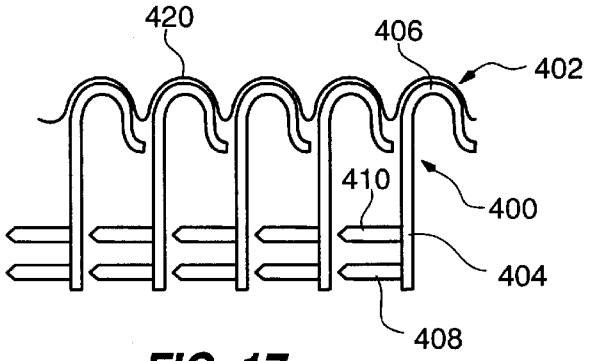
FIG. 17
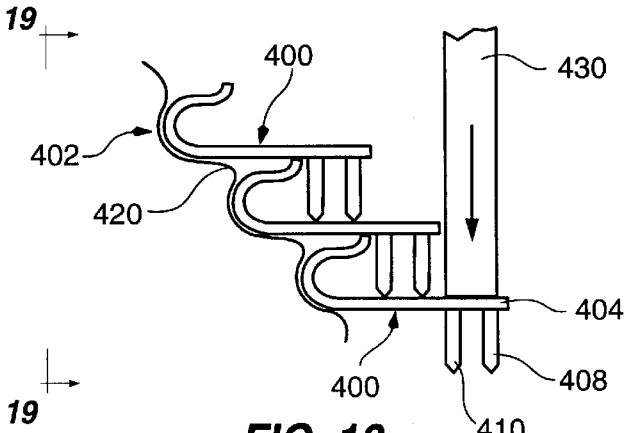
FIG. 18
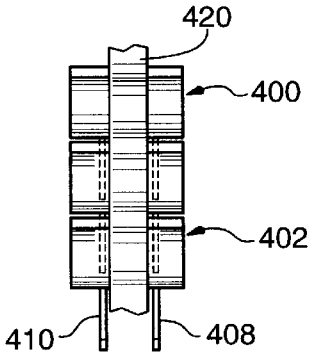
FIG. 19
FIG. 20
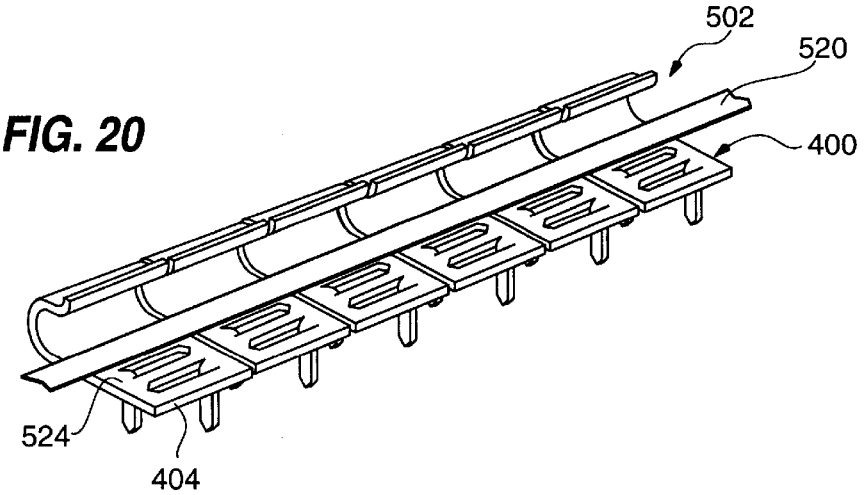

STRING OF ANCHOR CLIPS

CROSS REFERENCE TO RELATED APPLICATIONS

This application is a continuation-in-part of application Ser. No. 08/649,812 filed on May 17, 1996, now abandoned.

BACKGROUND OF THE INVENTION

1. Field of the Invention.

The present invention relates to anchor clips and to a string of such clips which are of the type that are stamped, punched and cut from an elongate strip of sheet metal stock in an end-to-end arrangement and which are applied to the wooden rails of furniture frames, such as opposite rails of the seat or back rest of a chair, for anchoring the end sections of sinuous or undulating cushion-supporting springs that extend between opposite rails.

2. Description of the Related Art Including Information Disclosed Under 37 CFR §§ 1.97–1.99.

Heretofore, it has been proposed to manufacture a string of anchor clips in a side-by-side arrangement from a length or strip of flat sheet metal clip-forming stock by passing the strip of stock through the working area of a punch press where various sequential punching, slitting, severing, bending, stamping and other operations are performed upon the strip of metal stock to produce a string of anchor clips arranged and connected side-by-side, the adjacent clips being connected to each other by a swaged web or webbing of metal between and connecting adjacent sides of adjacent clips. This string of clips is described in more detail in the Pearson U.S. Pat. No. 4,189,523, which is incorporated herein by reference.

Another type of clip having a generally U-shape is disclosed in the Oddy U.K. Patent Application No. GB 2 023 216. This patent teaches a plurality of inverted U-shaped clips which are arranged adjacent to each other with the bight of each U defining a generally semi-cylindrical head or crown, each having at least one notch therein aligned with a notch on an adjacent clip and an elongate spine of a frangible material is pressed into the aligned notches.

In applicant's earlier U.S. Pat. No. 5,303,821, there is disclosed a string of inverted U-shaped clips where the side edges of the head or bight portion of each clip are pressed toward each other to cause the metal of the bight portion to be crimped against an elongate flexible member received loosely in a trough defined by aligned notches in the bight or head portions of the clips in the string of clips that are arranged in a row.

Anchor clips of the type which are described herein are disclosed in the Frazier et al. U.S. Pat. No. 4,935,998.

SUMMARY OF THE INVENTION

According to the present invention there is provided an elongate string of sheet metal anchor clips including a series of identical anchor clips disposed in a line, each clip including a flat base portion, an hook shaped end portion, and a strip of flexible material fixed to each one of the clips to form the string of clips.

BRIEF DESCRIPTION OF THE DRAWINGS

FIG. 17 is a side elevational plan view of a string of modified anchor clips each of which only has a flat base portion, mounting prongs extending from the flat base portion and a hook-shaped end portion.

FIG. 18 is a side elevational view similar to the view in FIG. 17 of the string of clips but showing the string of clips rotated 90° counterclockwise and with the clips offset from one another.

FIG. 19 is a top side elevational view of the string of clips shown in FIG. 18 and is taken along line 19—19 of FIG. 18.

FIG. 20 is a perspective view of a modified string of clips wherein the clips are located side by side and held together in an assembly or string by a strip of material that extends transversely across the side by side arrangement of the clips and on an upper or outer surface portion of the flat base portion of each clip and affixed to the upper or outer surface of the flat base portion of each clip.

DESCRIPTION OF THE PREFERRED EMBODIMENT(S)

Figure 1:
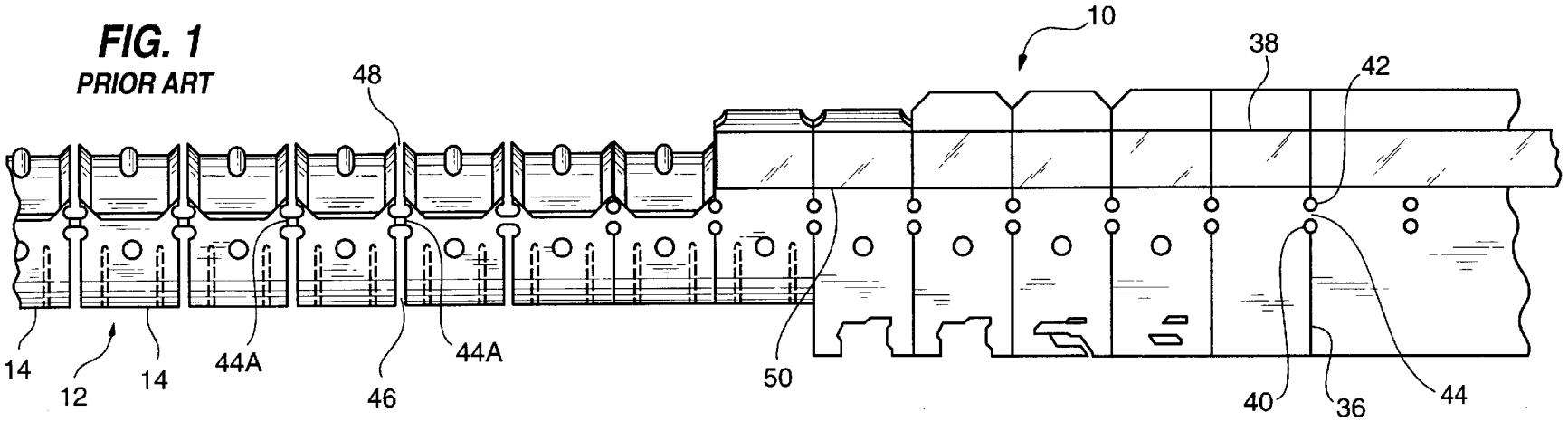
FIG. 1 PRIOR ART
FIG. 1 is a fragmentary plan view of a prior art length or strip of flat sheet metal anchor clip-forming stock and illustrates, in schematic fashion, the passage of the strip of stock through the working area of a punch press and shows the nature of the various sequential punching, slitting, severing, bending, stamping and other operations which are performed upon the strip of stock during its step-by-step passage through the working area in the production of an elongate, side-by-side, flexible string of anchor clips capable of being coiled into a coil for subsequent feeding to an anchor clip applying tool.
Figure 2:
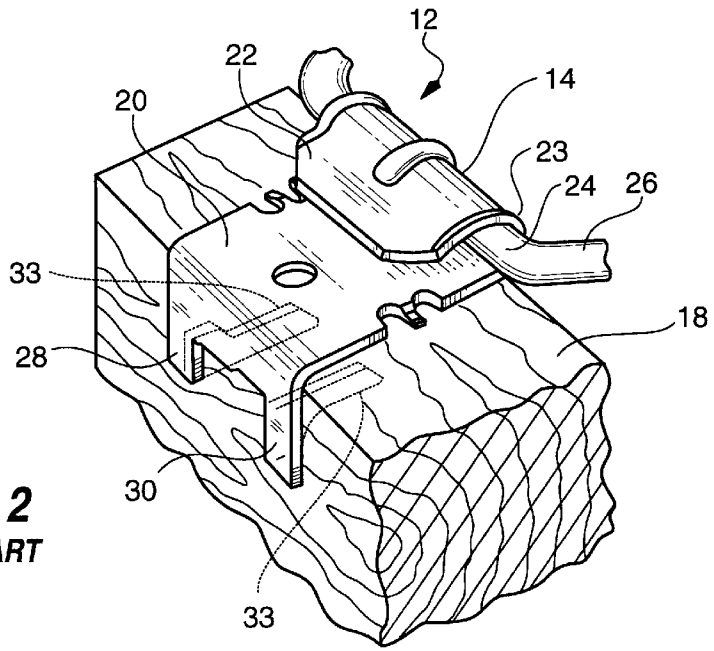
FIG. 2 PRIOR ART
FIG. 2 is a perspective view of one of the prior art anchor clips taken from the string of anchor clips shown in FIG. 1 and installed upon a wooden furniture rail.

Referring now to the drawings in greater detail, there is illustrated in FIG. 1, a prior art elongate ribbon-like strip 10 of flat sheet metal stock which is subjected to sequential operations as it is fed through the working area of a punch press and which then emerges from the punch press in the form of a continuous flexible string of a side-by-side interconnected string 12 of anchor clips 14, one of which is shown in FIG. 2 fixed to a wooden furniture rail 18. The clip 14 is adapted to receive the end section 24 of an elongate zig-zag, sinuous or undulating cushion support spring 26 which is arched and is highly resilient and spans the opening of a wooden frame defined between spaced apart wooden rails 18.

As best shown in FIG. 2, the clip 14 includes a flat base portion 20 which is adapted to be seated upon a surface of the rail 18. An inner end 21 of the base portion 20 (i.e. the end which faces the furniture frame opening) is constructed with a hook or U-shaped cross-section, including a reverse bend portion 22 and a bight portion 23 between the base portion 20 and the reverse bend portion 22 for receiving the end section 24 of a zig-zag or undulating cushion-supporting spring 26. At the outer end of the base portion 20, the clip 14 includes a downturned leg 28 which extends along a side surface of the rail 18. The leg 28 is formed with a rectangular void or recess 30 defined between vertical side edges from which are formed prong portions which are laterally bent so as to provide a pair of inwardly extending anchor prongs 32 and 33 which are adapted to penetrate and imbed in the rail 18 for properly positioning the clip 14 on the rail 18.

In the forming of the string 12 of clips 14 as shown in FIG. 1, transverse slits 36 and 38 are cut into the strip 10 from each edge thereof to a circular punchout 40 or 42 defining therebetween a web or webbing 44 of material between adjacent sides of adjacent clip blanks in the strip 10. Then the webbing 44 is swaged, 44A to reduce the thickness of the webbing 44 and to extend the width of the slits 36 and 38 to form slots 46 and 48 between adjacent sides of adjacent clips 14. The webbing 44 of reduced thickness also imparts flexibility to the string 12 of the clips 14.

In the construction of the prior art strip 12 of clips 14, an elongated strip of plastic material 50 is adhered to the strip 10 of metal stock in the area where the reverse bend portion 22 is bent to form the bight 23 which receives the end section 24 of one of the springs 26.

From the foregoing description, it will be apparent that the prior art anchor clips 14 are connected together in a side-by-side arrangement in the string 12 by the web or webbing 44A and are each mounted to a rail 18 in a direction transversely of the strip 12, first by severing the web or webbing 44A and then moving or pounding each clip 14 transversely of the elongate axis of the strip 12 into the wooden rail 18. This requires moving the strip 12 along the length of the rail 18, cutting the webbing 44A, and sequentially hammering or pounding each clip 14 into the rail 18 at selective locations along the length of the rail 18.

In the prior art field of wire binding clips, the clips have been loose and mounted with fasteners, such as stables, or were held in a string with metal webbings between adjacent clips. The metal webbings limited the flexibility of the string of clips and loose clips required pope orientation of the clips for mounting each clip to a wooden furniture rail.

Figure 3A:
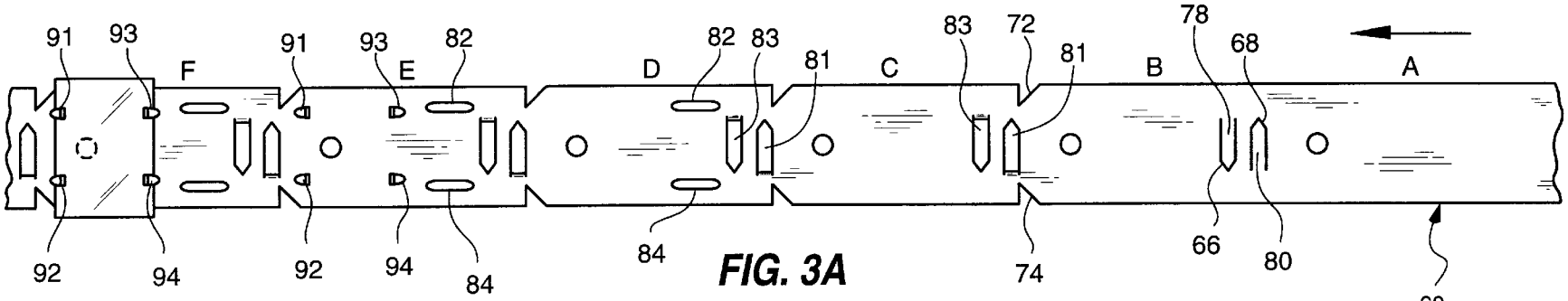
FIGS. 3A, 3B and 3C comprise a fragmentary top plan view of a length or strip of flat sheet metal clip-forming stock illustrating in schematic fashion the passage of the strip of stock through the working area of a punch press and showing the nature of the various punching, slitting, severing, bending, stamping and other operations formed upon the stock during the step-by-step passage of the strip of stock through the working area in the production of an elongate flexible string of anchor clips which are arranged and connected end-to-end by a pair of plastic wires, which are constructed according to the teachings of the present invention and which are capable of being coiled into a coil.
Figure 3B:
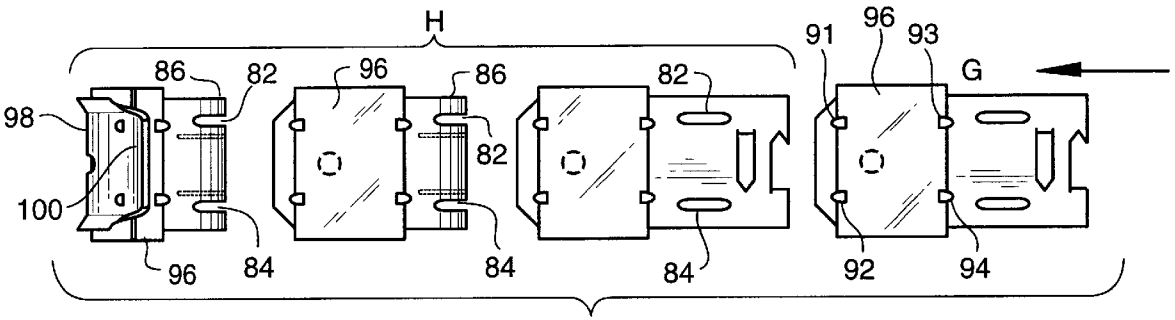
Figure 3C:
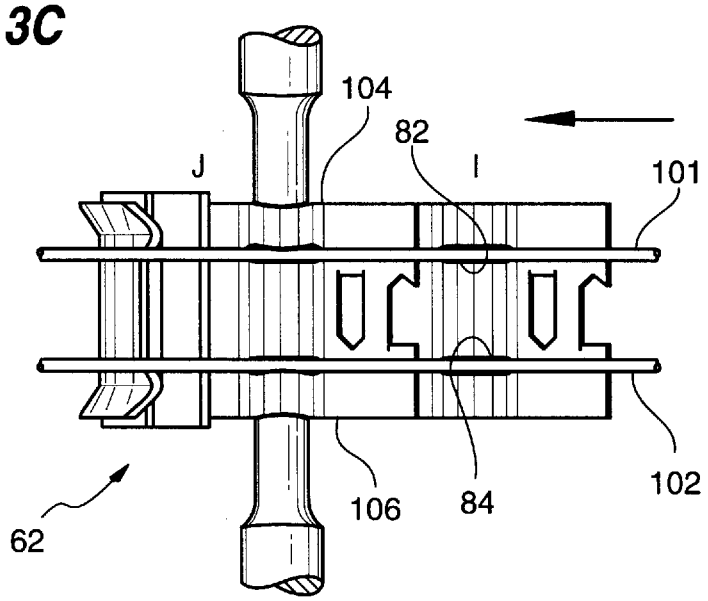

Referring now to FIGS. 3A–C, there is illustrated therein an elongate ribbon-like strip 60 of flat sheet metal stock which is fed through the working area of a punch press where various punching or stamping operations A–L are performed on the strip 60 to create a string 62 (FIG. 4) of the clips 64 constructed according to the teachings of the present invention.

The punching and stamping operations are defined as follows:

(A) Slits 66 and 68 are cut into the strip 60;

(B) Corner notches 72 and 74 are punched in the strip 60

Figure 6:
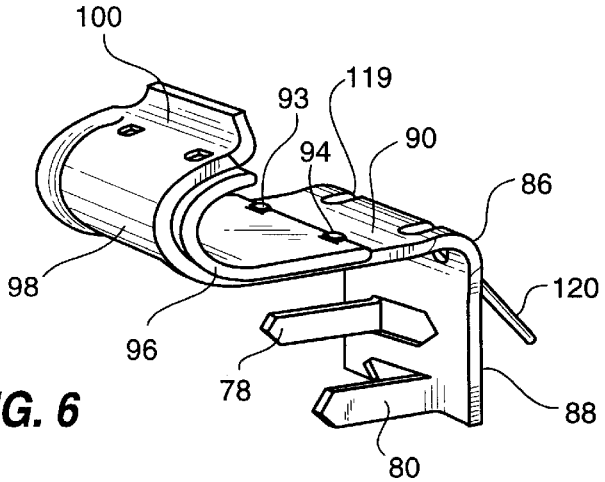
FIG. 6 is a perspective view of one of the anchor clips from the string of anchor clips of the present invention shown in FIG. 4 after the anchor clip is cut or severed from the string of anchor clips.

(C) Prongs 78 and 80 are formed between the slots 66 and 68 and bent downwardly so form the open spaces 81 and 83;

(D) Wire receiving slots 82 and 84 are now punched into the strip 60 in the area which will become a corner 86 between a downturned leg 88 and a flat base portion 90 of the clip 64 shown in FIG. 6;

(E) Four (4) plastic liner-piercing tabs 91–94 are lanced or formed in the strip 60;

(F) A rectangular plastic liner 96 is positioned over the tabs 91–94 and pressed downwardly onto the tabs 91–94;

(G) The tabs 91–94 are folded outwardly of an area which will become a bight portion 98 of the clip 64 as shown in FIG. 6 to fix the liner 96 in place;

(H) The outer most clip 64 is sheared from the strip 60, the rear area is now bent approximately 90° from the flat base portion 90 to form the downturned leg 88, and the forward end area is now bent upwardly to form the bight portion 98 and a reverse bend portion 100;

(I) The clip 64 is rotated approximately 25° and a spaced apart pair of plastic wires 101 and 102 are placed, respectively, into the slots 82 and 84; and (J) Pressure is applied against each side edge 104 and 106 of the clip 64 in the area of the bight portion 98 of the clip 64 to press the metal at the edges of the slots 82 and 84 against the plastic wires 101 and 102.

Figure 4:
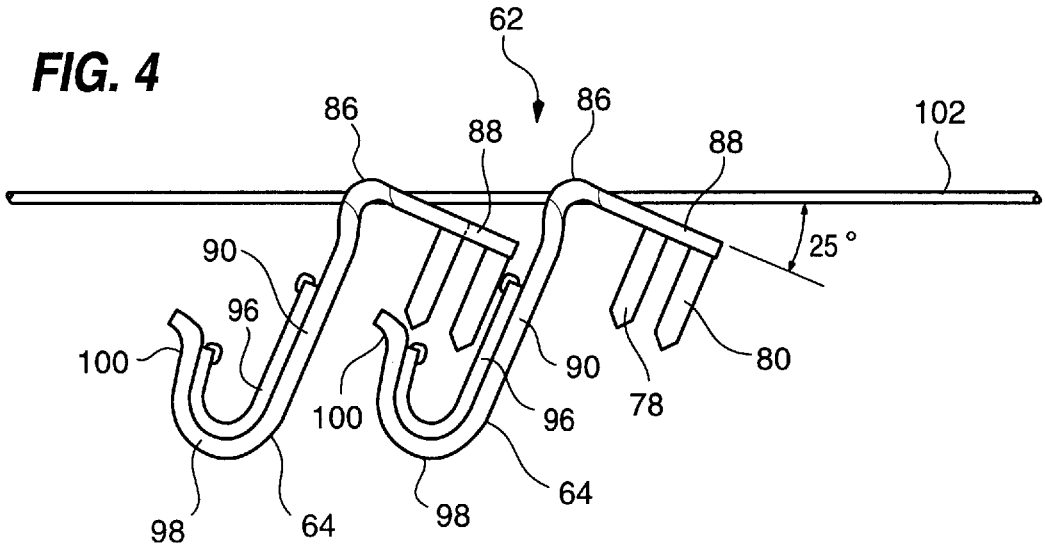
FIG. 4 is a fragmentary side elevational view of a portion of the string of anchor clips shown in FIG. 3.

A portion of the string 62 of the anchor clips 64 created as a result of the operations A–J is shown in FIG. 4.

As shown at step (F), the plastic liner 96 has a length greater than the width of strip 60 to ensure that the metal at the edges of the bight portion 98 do not engage an end section 24 of one of the zig-zag or undulating springs 26 and create squeaking noises.

Figure 5:
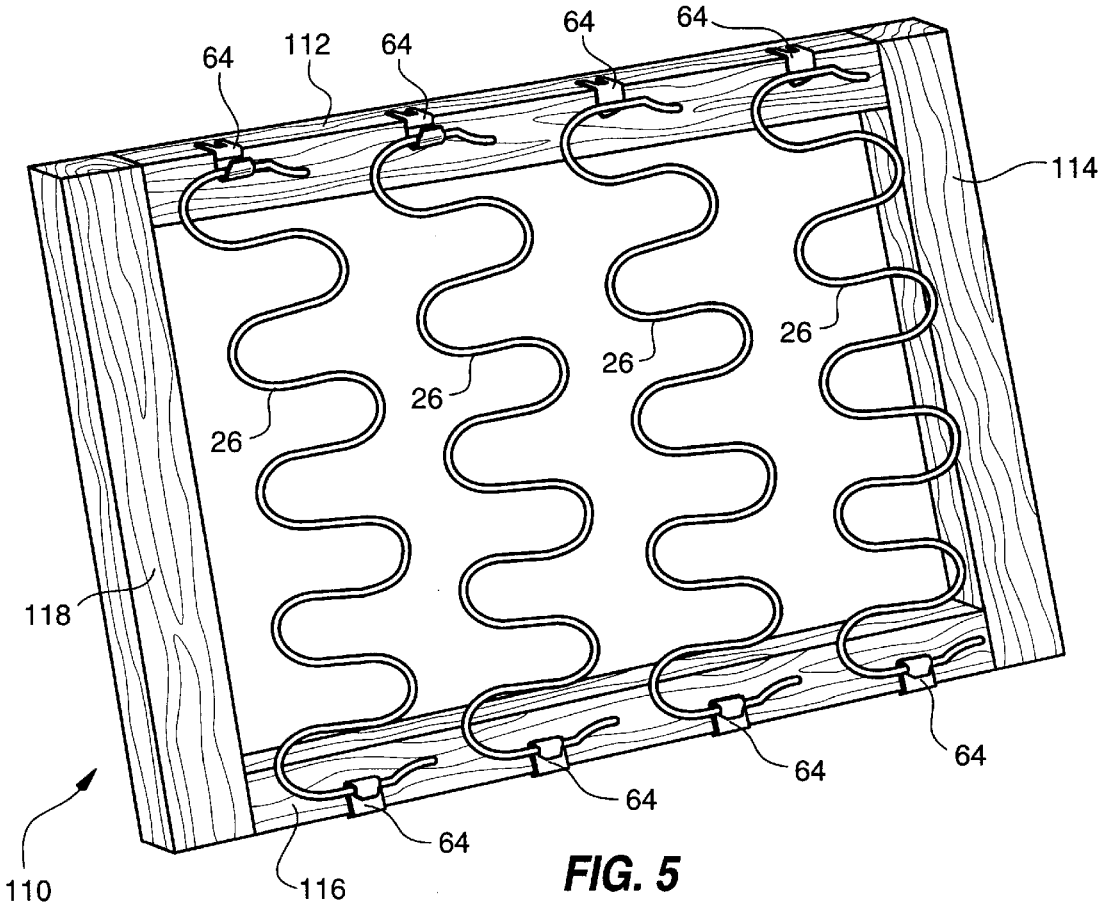
FIG. 5 is a perspective view of a back rest or seat rest of a chair showing eight (8) anchor clips from the string of anchor clips shown in FIG. 4 mounted, four (4) each in a spaced apart manner, on the upper and lower rails, respectfully, of the back rest with four (4) undulating springs extending between each pair of opposed anchor clips.

The anchor clips 64 are used primarily for anchoring the end sections 24 of sinuous cushion-supporting springs 26. In this respect, and as best shown in FIG. 5, four (4) springs 26 are mounted across a generally rectangular wooden frame 110, comprising four (4) wooden rails 112, 114, 116, and 118. Four (4) anchor clips 64 are mounted to an upper surface of the upper wooden rail 112 and four (4) additional anchor clips 64 are mounted to the upper surface of the lower wooden rail 116 each in alignment with an opposite one of the four (4) clips 64 mounted to the upper rail 112.

In FIG. 6 there is illustrated an anchor clip 64 after it has been separated from string 62 by the cutting of the plastic wires 101, 102, leaving plastic wire sections 119, 120 pinched in wire receiving slots 82 and 84.

From the foregoing description, it will be apparent that the method for forming and the string assembly 62 of clips 64 formed thereby of the present invention have a number of advantages, some of which have been described above and others of which are inherent in the invention.

For example, the string 62 can be easily coiled onto a spool for being mounted into a magazine and then dispensed through a clip dispensing tool. Furthermore, four (4) such clip dispensing tools can be arranged side-by-side so that four (4) anchor clips 64 can be pounded or struck into an outer side surface of the wooden rail 112 or 116 at the same time. For this purpose the magazine can be defined by a reel mounted on a support shaft. If desired, the reel can have sufficient width to mount four (4) coils of strings 62 of anchor clip 64 for simultaneous dispensing to four (4) clip dispensing tools.

Furthermore, the mounting of the plastic liner 96 by the tabs 91–94 ensures the solid mounting of the liner 96 in place for the life of the clip which avoids the frequent breakdown of adhesive used to hold the plastic liner to a prior art anchor clip.

Also it will be understood that modifications can be made to the method of forming, the string assembly of clips formed thereby and each anchor clip described above without departing from the teachings of the present invention.

Figure 7:
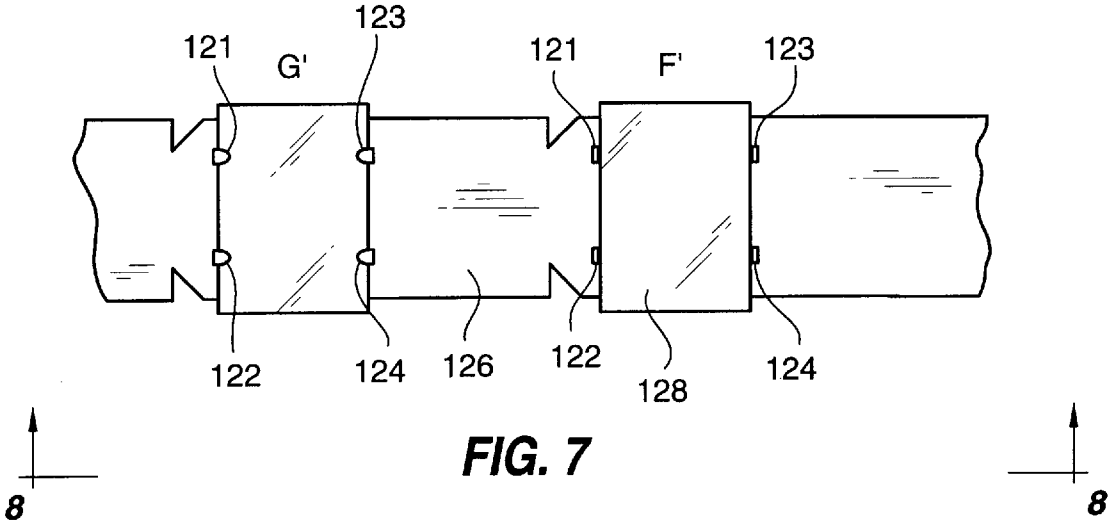
FIG. 7 is a plan view of a modified strip of sheet metal in which four tabs are formed for receiving a plastic liner between the tabs.
Figure 8:
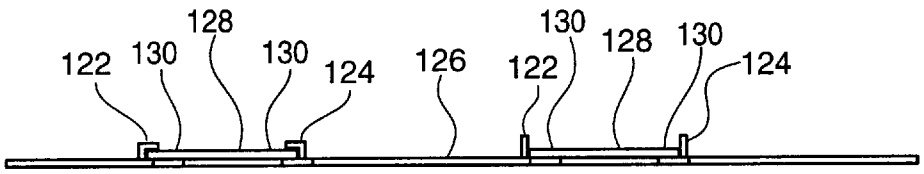
FIG. 8 is a side elevational view of the strip of sheet metal shown in FIG. 7 and is taken along line 8—8 of FIG. 7.

For example. and as shown in FIGS. 7 and 8, four (4) tabs 121–124 can be formed in a strip 126 of sheet metal from which anchor clips, similar to anchor clips 64, can be formed. The tabs 121–124 are located on either side of an area which will form the bight portion of a hook shaped end portion of the anchor clip. Then, a rectangular plastic liner 128 is installed or inserted from the side of the clip 44 at substantially 90° to the feed direction of the partially formed clips 44 in the clip forming process described above and placed between the tabs 121–124 Then, in a subsequent operation, the tabs 121–124 are folded toward each other and over the edges of the plastic liner 128.

Preferably, the tabs 121–124 are punched from an area in the strip 126 which will underlie the plastic liner 128 so that when the tabs 121–124 are folded over a margin of the plastic liner 128 and pushed against the plastic liner 128, plastic material on the underside of the plastic liner 128 will be urged into the hole or opening 130 from which the tab 121, 122, 123 or 124 is punched. In this way, the liner 128 engaging the side edges of the openings 130 from which the tabs 121–124 are punched so that the liner will not slide in the bight portion of the clip, thereby firmly securing the anchor clip without piercing the liner 128.

While the provision of one or two slots 82 or 84 for receiving a plastic wire 102 crimped in the aligned slots 82 in adjacent clips 64 to create a string of clips provides a simple way for connecting the clips 64 in a string for rolling the clips up in a roll, according to the teachings of the present invention other means, such as an adhesive tape, can be used for connecting the clips 64 or 14 end-to-end or side-by-side string of clips.

Figure 9:
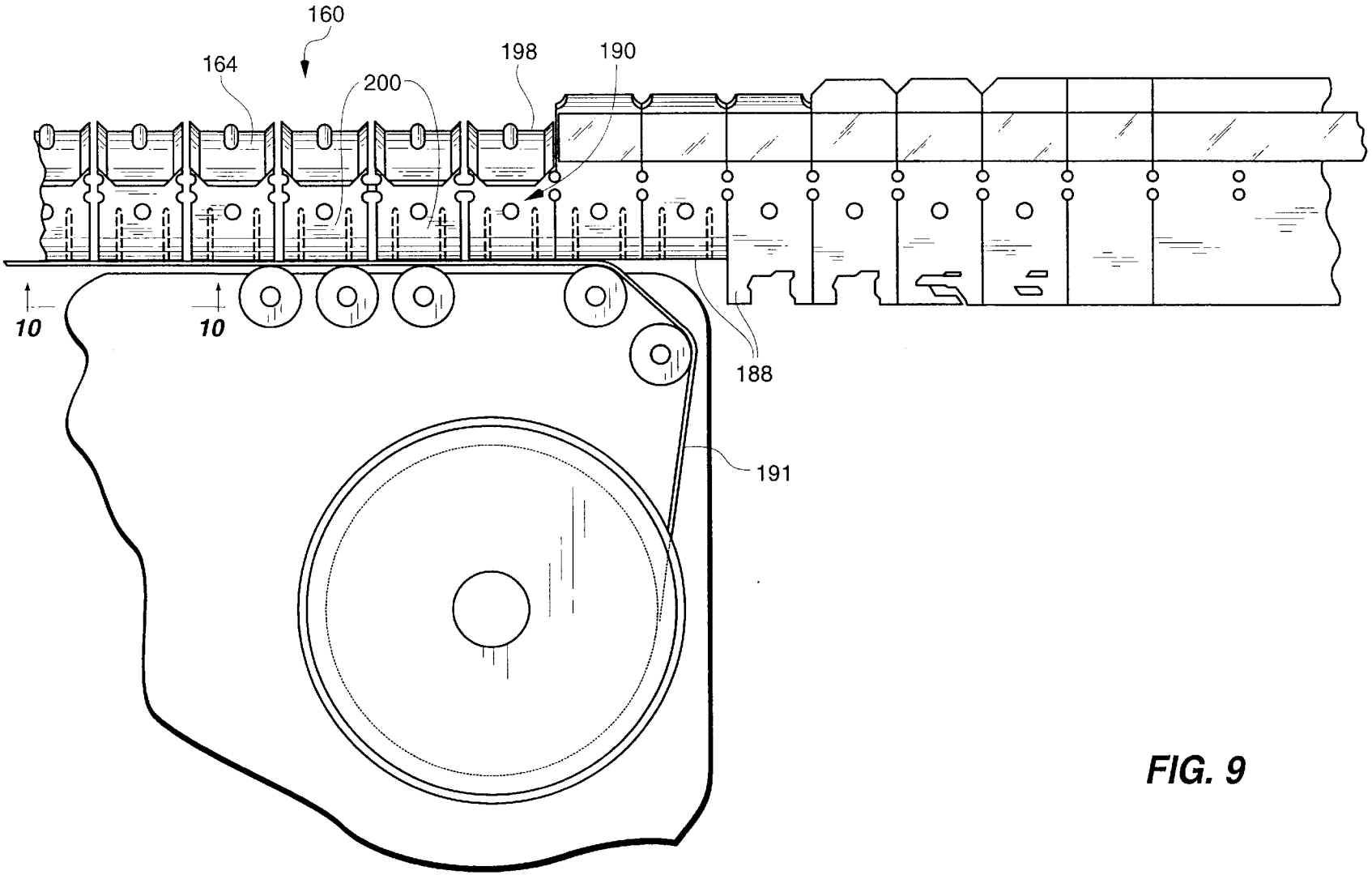
FIG. 9 is a fragmentary plan view of a length or strip of flat sheet metal anchor clip-forming stock and illustrates, in schematic fashion, the passage of the strip of stock through the working area of a punch press and shows the nature of the various sequential punching, slitting, severing, bending, stamping and other operations which are performed upon the strip of stock during its step-by-step passage through the working area in the production of an elongate, side-by-side, flexible string of anchor clips which are connected in a string by an adhesive tape and which is capable of being coiled into a coil for subsequent feeding to an anchor clip applying tool.
Figure 10:
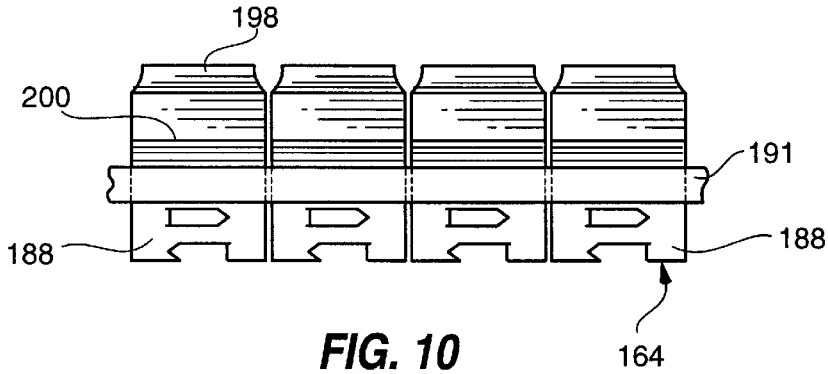
FIG. 10 is a fragmentary side elevational view of a portion of the string of anchor clips arranged side-by side as shown in FIG. 9 and is taken along line 10—10 of FIG. 9.

As best shown in FIG. 9, a string 160 of side-by-side clips 164 can be formed in a manner similar to the manner disclosed in U.S. Pat. No. 4,189,523 but modified to facilitate connecting the clips 164 each having a downturned leg 188 and a flat base portion 190. In this respect, the clips 164, after the turning down of the downturned leg 188 thereof, have a continuous strip of transparent, translucent or opaque adhesive tape 191 fixed to the outer surface 192 of each downturned leg 188. Also, instead of forming a webbing 44 between adjacent clips the metal area between adjacent clips 164 is severed when or after a bight portion 198 is formed. In this way, a strip or string 160 of side-by-side clips 164 is formed.

Alternatively, the continuous strip of transparent, translucent or opaque adhesive tape 191 can be applied to an outer surface 200 of the flat base portion 190 of each clip 164 before the metal between the clips 164 is severed.

Figure 11:
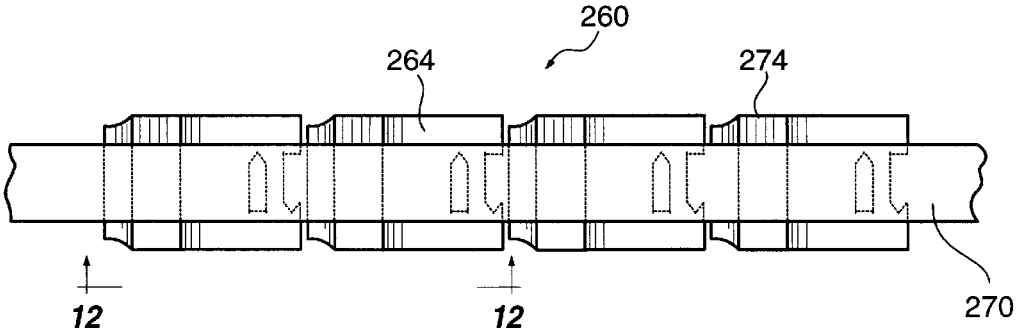
FIG. 11 is a fragmentary plan view of a portion of a string of anchor clips, similar to the view shown in FIG. 3C., but showing the string of clips releasably secured together by a strip of adhesive tape secured to the corner of each clip between the flat base portion and the downturned leg of the clip and/or the outer surface of each downturned leg of each clip, instead of by plastic wires received in slots in the corner of each clip.
Figure 12:
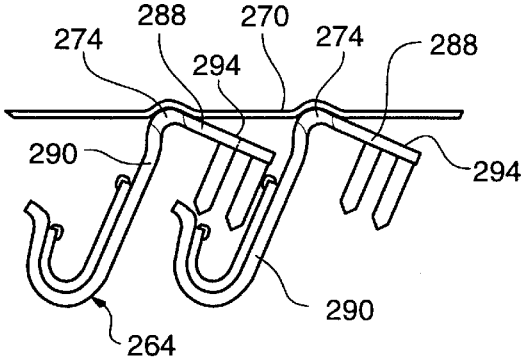
FIG. 12 is a fragmentary side elevational view of a portion of the string of anchor clips shown in FIG. 11 and shows the adhesive tape connected to the corner of each clip and is taken along line 12—12 of FIG. 11.
Figure 13:
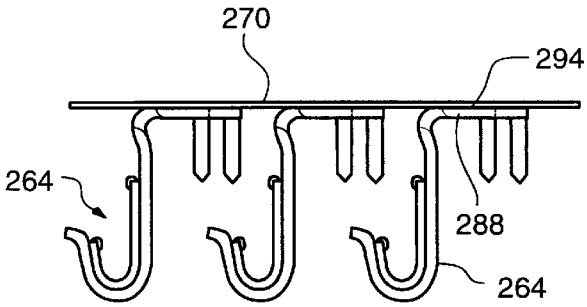
FIG. 13 is a fragmentary side elevational view of a portion of the string of anchor clips, similar to the view shown in FIG. 12, but with each clip rotated counterclockwise to a 90 degree position so that the adhesive tape can contact and adhere to the outer surface of the downturned leg of each clip.

As shown in FIGS. 11–13, a string 260 of clips 264 arranged end-to-end can be formed without the slots 82 or 84.

After the string 260 of clips 264 is formed, a continuous strip of tape 270 having adhesive thereon can be secured to the corners 274 between a downturned leg 288 and a flat base portion 290 of each clip 264.

The adhesive can be a tacky cold adhesive or it can be a hot melt, thermoplastic adhesive.

Also, as shown in FIG. 13, each clip 264 can be rotated upwardly counterclockwise to a 90° position so that adhesive on the underside of the tape 270 can be adhered to an outer surface 294 of each downturned leg 288 of each clip 264 to ensure a firm connection of each clip 264 to the tape 270.

As a further alternative, the string of clips shown in FIG. 9 or the string of clips shown in FIG. 11 can have a tab punched out of a downturned leg or out of a flat base portion of each clip. Then, a strip or wire of flexible material, such as, for example, a plastic wire can be positioned adjacent the tab followed by crimping of the tab over the strip of wire thereby to secure the clips together in a string.

Figure 14:
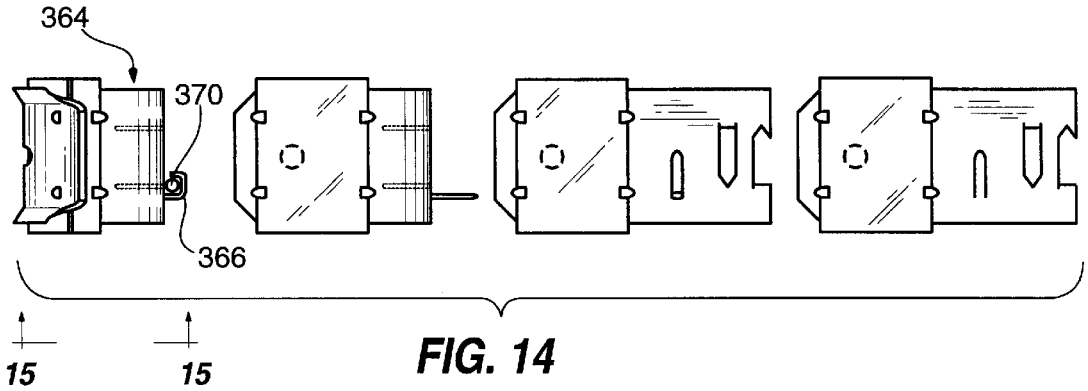
FIG. 14 is a fragmentary top plan view of a portion of a length or strip of flat sheet metal clip-forming stock illustrating in schematic fashion the passage of a portion of the strip of stock through part of the working area of a punch press and showing the nature of some of the various punching, slitting, severing, bending, stamping and other operations formed upon the stock during the step-by-step passage of the strip of stock through the working area in the production of an elongate flexible string of anchor clips which are arranged end-to-end, which have a tab formed to extend outwardly from the outer surface of the downturned leg of the clip that is crimped over an elongate connecting member or wire for connecting the clips together, which are constructed according to the teachings of the present invention and which are capable of being coiled into a coil.
Figure 15:
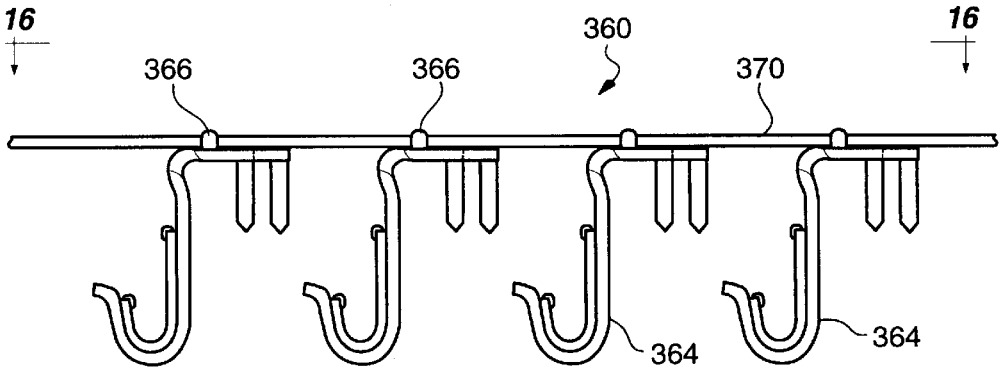
FIG. 15 is a side elevational view of the string of clips shown in FIG. 14 and is taken along line 15—15 of FIG. 14.
Figure 16:
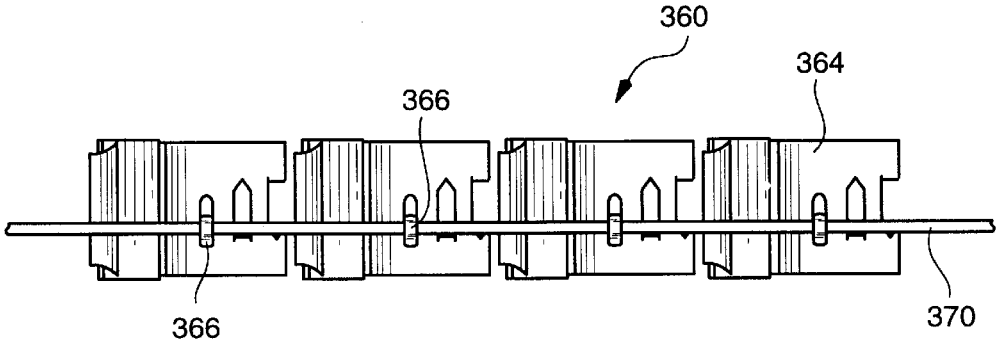
FIG. 16 is a fragmentary top plan view of the string of clips shown in FIG. 15 and is taken along line 16—16 of FIG. 15.

The string 360 of clips 364 shown in FIGS. 14–16 are provided with such a tab 366 which is punched out of the downturned leg for being crimped over a plastic wire 370.

It will be understood that such a tab 366 can alternatively be formed in the downturned leg or in the flat base portion of each clip in the string of clips shown in FIGS. 9, 11 or 14.

In FIGS. 17, 18 and 19, there is illustrated a modified anchor clip 400 and a modified anchor clip assembly or string 402.

Each anchor clip 400 has a flat base portion 404 extending to a hook-shaped end portion 406 at one end thereof. This particular anchor clip 404 is not provided with a downturned leg as in the previously described embodiments of the anchor clip 64, 164 and 264. Instead, two prongs 408 and 410 are punched out of the flat base portion 404 as shown.

Also, although not shown in FIGS. 17, 18 and 19, a plastic liner, similar to the liner 96, is suitably mounted by means of tabs, adhesive or hot melting to the inner bight of each hook-shaped end portion 406.

As shown in FIG. 17, a strip 420 of flexible material, such as adhesive tape or thermoplastic material, is fixed to the outer surface of each hook-shaped end portion 406 of each anchor clip 400.

The string or assembly 402 of anchor clips 400 can have the anchor clips 400 connected in the manner as shown in FIG. 17 which provides the assembly or string 402 with flexibility whereby the anchor clips 400 can be assembled in a roll.

In the alternative, the anchor clips 400 in the string 402 can be staggered as shown in FIG. 18 to enable an end section of the flat base portion 404 to be positioned beneath a reciprocating driver blade 430 For hammering or driving each anchor clip 400 into a wooden frame member, such as a wooden furniture rail.

FIG. 19 is a fragmentary plan view of the top side of the strip or assembly 402 of the anchor clips 400.

Referring now to FIG. 20, there is illustrated therein an assembly or string 502 of the anchor clips 400. Here a flexible strip 520 of material, such as adhesive tape or thermoplastic material is fixed to an upper or outer surface 524 of the flat base portion 404 of each anchor clip as shown.

The flexible strip 420 or 520 provides the assembly or string 402 or 502 of anchor clips 400 with flexibility in storing the clips 400, e.g. coiling them, in dispensing them to a pneumatic applying tool including a driver blade 430 and provides ease in the mounting of the clips 400 to wooden furniture rails via a driver blade, such as the driver blade 430.

Accordingly, the scope of the invention is only to be limited as necessitated by the accompanying claims.

I claim:

1. For use in a clip clamping machine having an inlet and an outlet end, having an elongate magazine in line with said outlet end and being adapted to be positioned perpendicular to a furniture rail, an elongate string of sheet metal anchor clips including a series of separate, identical anchor clips assembled end-to-end in a line for being fed through the magazine of the clip clamping machine in a direction perpendicular to a furniture rail to which each clip is affixed, each clip including a flat base portion, an hook shaped end portion, a downward leg and a junction between said base portion and said downward leg defining a corner, a non-metallic liner positioned in each said hook shaped end portion, and a separate, elongate, strip of flexible material, not forming any part of said liner, fixed to each one of said clips to hold said string of clips together in an end-to-end string of clips, whereby a plurality of clip clamping machines can be arranged perpendicular to the furniture rail so that a plurality of clips can be discharged in line with each clip clamping machine and fixed at about the same time to the rail thereby to decrease substantially the time required for fixing clips to the rail.

2. The string of anchor clips of claim 1 wherein said strip is a flexible, non-metal strip.

3. The string of anchor clips of claim 2 wherein said strip has an adhesive material on one side thereof.

4. The string of anchor clips of claim 3 wherein said adhesive is a cold tacky adhesive.

5. The string of anchor clips of claim 3 wherein said adhesive is a hot melt, thermoplastic adhesive.

6. The string of anchor clips of claim 1 wherein said strip of material is affixed to said corner of each clip between said flat base portion and said downturned leg of each clip.

7. The string of anchor clips of claim 1 wherein said strip of material is affixed to the outer surface of said downturned leg of each clip.

8. The string of anchor clips of claim 1 wherein said downturned leg has a tab punched therefrom, said tab extending outwardly from the outer surface of the downturned leg and said strip of flexible material being positioned adjacent said tab and said tab being crimped over said strip to secure said strip to each said clip.

9. The string of anchor clips of claim 1 wherein said flat base portion has a tab punched therefrom, said tab extending outwardly from the outer surface of the downturned leg and said strip of flexible material being positioned adjacent said tab and said tab being crimped over said strip to secure said strip to said clip.

10. The string of anchor clips of claim 1 wherein said corner has at least one slot therein extending across said corner, and said flexible strip comprises a flexible elongate member which is received in said slot and crimped therein to hold said clips together in an end-to-end string of clips.

11. The string of anchor clips of claim 1 wherein said strip of material is affixed to the outer surface of said flat base portion of each clip.

12. The string of anchor clips of claim 1, which are used to attach sinuous springs to furniture rails and which are fed to the rails in a direction perpendicular to the rails, wherein said non-metallic liner is inserted into each hook shaped end portion from a side of said clip parallel to a center axis of a bight portion of said hook shaped end portion and fixed in said hook shaped end portion whereby said liner can have a small overlap over each side of said hook shaped end portion so that said liner and said overlap can prevent metal-to-metal contact between said anchor clip and a section of the sinuous spring received in said hook shaped end portion.

13. The string of anchor clips of claim 12 wherein said liner is attached to said anchor clip with one or more tabs formed from and integral with said clip.

14. The string of anchor clips of claim 1 wherein said downturned leg has at least one prong extending therefrom and each anchor clip is an upholstery spring anchoring clip of the type which is designed for positioning of said flat base portion on the top surface of a wooden furniture rail and for positioning of said downturned leg in face-to-face engagement with an outer side surface of the rail for being struck or pounded to pound said at least one prong extending from said downturned leg into the outer side surface of the rail.

15. The string of anchor clips of claim 14 wherein said hook shaped end portion of each anchor clip is fitted with a plastic liner, longer than the hook shaped end portion, in a bight portion of said hook shaped end portion, with said liner overlapping each side of said hook shaped end portion, said liner receiving an end section of a sinuous shaped cushion-supporting spring and said liner preventing metal-to-metal contact between said anchor clip and the end section of the sinuous spring.

16. The string of anchor clips of claim 15 including at least two tabs, each tab extending outwardly from said clip at each edge of said bight portion and said plastic liner being received between said at least two tabs, located, respectively, on each side of said bight portion, with each tab being folded over an adjacent edge of said plastic liner and against a margin of said liner to hold said liner in place.

17. The anchor clip of claim 16 wherein said tabs are punched from an area in said clip which will underline said plastic liner so that when said tabs are folded over a margin of said liner and pushed against said liner, plastic material on the underside of said liner will be urged into the hole from which said tab is punched to fix said liner in place in the bight portion of said hook shaped end portion.

18. A clip clamping machine having an inlet end and an outlet end, having an elongate magazine in line with said outlet end, having a hammer or striker for pounding a clip at the outlet end into a furniture rail and being adapted to be positioned perpendicular to a furniture rail and an elongate string of sheet metal anchor clips including a series of separate, identical anchor clips assembled end-to-end in a line for being fed through said magazine of said clip clamping machine in a direction perpendicular to a furniture rail to which each clip is affixed, each clip including a flat base portion, an hook shaped end portion, a non-metallic liner positioned in each hook shaped end portion, and a separate, elongate, strip of flexible material, not forming any part of said liner, fixed to each one of said clips to hold said string of clips together in an end-to-end string of clips, whereby a plurality of said clip clamping machines can be arranged perpendicular to a furniture rail so that a plurality of said clips can be discharged in line with each clip clamping machine and fixed at approximately the same time to the rail thereby to decrease substantially the time required for fixing a plurality of clips to the rail.

* * * * *

UNITED STATES PATENT AND TRADEMARK OFFICE

CERTIFICATE OF CORRECTION

PATENT NO. : 5,833,064
DATED : November 10, 1998
INVENTOR(S) : Donald B. Ayres and Glen Gustafson It is certified that error appears in the above-indentified patent and that said Letters Patent is hereby corrected as shown below:

Column 4, line 39, "stables" should be --staples--;

Column 4, line 42, "pope" should be --rope--;

Column 4, lines 55 and 56, "66 and 68" should be --66, 68 and 76--;

Column 4, line 56, "so" should be --to--;

Column 5, line 35, "119, 120" should be --121, 122--;

Column 7, line 29, "For" should be --for--;

Column 7, line 58, "downward" should be --downturned--;

Column 7, line 59, "downward" should be --downturned--.

Signed and Sealed this

Fourteenth Day of September, 1999

*Attest:*

Q. TODD DICKINSON

*Attesting Officer*

*Acting Commissioner of Patents and Trademarks*